United States Patent [19]

Merkel

[11] 4,249,326

[45] Feb. 10, 1981

[54] ROUTER BIT

[75] Inventor: Russell D. Merkel, Coal City, Ill.

[73] Assignee: Caterpillar Tractor Co., Peoria, Ill.

[21] Appl. No.: 38,983

[22] PCT Filed: Mar. 5, 1979

[86] PCT No.: PCT/US 79/00133

§ 371 Date: Mar. 5, 1979

§ 102(e) Date: Mar. 5, 1979

[87] PCT Pub. No.: WO80/01926

PCT Pub. Date: Sep. 18, 1980

[51] Int. Cl.[3] ..... E02F 9/28

[52] U.S. Cl. ..... 37/141 T; 37/142 R

[58] Field of Search ..... 37/141 R, 141 T, 142 R, 37/142 A; 172/719, 737, 777, 762, 767

[56] References Cited

U.S. PATENT DOCUMENTS

| | | | |
|---|---|---|---|
| 2,831,275 | 4/1958 | Kimsey et al. | 37/141 T |
| 3,029,534 | 4/1962 | Rakisits | 37/141 R |
| 3,088,232 | 5/1963 | Gilbertson | 37/141 R |
| 3,465,833 | 9/1969 | Lutz | 172/719 |
| 3,520,076 | 7/1970 | Nichols | 37/141 |
| 3,643,357 | 2/1972 | Benning et al. | 37/141 R |
| 3,839,806 | 10/1974 | Hood et al. | 37/142 R |
| 3,994,084 | 11/1976 | Smith et al. | 37/141 R |

*Primary Examiner*—E. H. Eickholt

*Attorney, Agent, or Firm*—Wegner, Stellman, McCord, Wiles & Wood

[57] ABSTRACT

A router bit assembly (18,22) for the sides (20,24) of the bowl (10) of an earthmoving machine (12). The router bit assembly is of two-piece construction and includes a router bit (42) and a holder (26) which, when secured to the vertical side walls (20,24) of the bowl (10), captures the bit (42) between the holder (26) and the vertical side wall (24). The rear edge (56) of the bit (42) is held against the leading edge (58) of the corner (25) of the vertical side wall (24) by the holder (26). The two-piece router bit assembly advantageously reduces the amount of metal that is discarded when the life of the bit is expended.

9 Claims, 4 Drawing Figures

ROUTER BIT

DESCRIPTION

1. Technical Field

This invention relates to earthmoving equipment and, more particularly, to a quick-change replaceable router bit assembly mounted on the vertical walls of the leading edge or leading corner of the scraper bowl.

2. Background Art

Side cutting router bits mounted at corners where the earth-engaging blade meets the scraper bowl of earthmoving equipment are particularly useful in defining a sharp and clean boundary line when earth is removed during operation. The ground-engaging portion of the router bit is susceptible to a high degree of wear due to rocks and other hard material. Since the router bits experience different wear rates, individual replaceable router bits have been found to be particularly useful. Exemplary replaceable router bits are shown in Gilbertson U.S. Pat. No. 3,088,232, Lutz U.S. Pat. No. 3,465,833, Smith U.S. Pat. No. 3,994,084 and Hood et al U.S. Pat. No. 3,839,806.

It has been the practice to provide single-piece router bits which are detachably secured to the bowl of the earth-working machine by nut and bolt assemblies. In most instances the router bit itself is directly secured to the bowl by bolts extending through both the bit and the bowl. Other router bits are adjustable. For example, in U.S. Pat. No. 3,994,084 to Smith, a slidable router bit can be adjusted to accommodate the wear which takes place along the forward edge of the tool. Additional support straps across the bit and secured to the side of the bowl are helpful for retention. Even these bits are secured to the bowl by a plurality of nut and bolt assemblies.

A significant amount of material is rendered useless with single-piece and double-piece router bits known to the prior art after the ground-engaging portion of the tool wears away.

DISCLOSURE OF INVENTION

The present invention is directed to overcoming one or more of the problems as set forth above.

In one aspect of the invention, the amount of material which is rendered useless is minimized by providing a router bit assembly of a two-piece construction. The first piece of the router bit assembly is a holder which is detachably mounted on the bowl at the corners of the blade where the blade meets the vertical walls of the bowl. The second piece of the router bit assembly includes a metal bit having a configuration adapted to be received within the holder. The bit is inserted within the holder to form the router bit assembly which is then coupled and secured to the vertical side wall of the bowl of the earth-working equipment at the leading edge or the leading corner of the ground-engaging blade. When the bit is worn away, the holder is detached from the bowl and the bit is removed therefrom and a new blade is inserted within the holder. Then the router bit assembly with the new bit therein is reattached to the vertical side wall of the bowl.

The use of a two-piece router bit assembly advantageously reduces the required amount of material which heretofore has been uselessly discarded after the cutting portion of the prior art bit wore away.

BEST MODE FOR CARRYING OUT THE INVENTION

Figure 1:
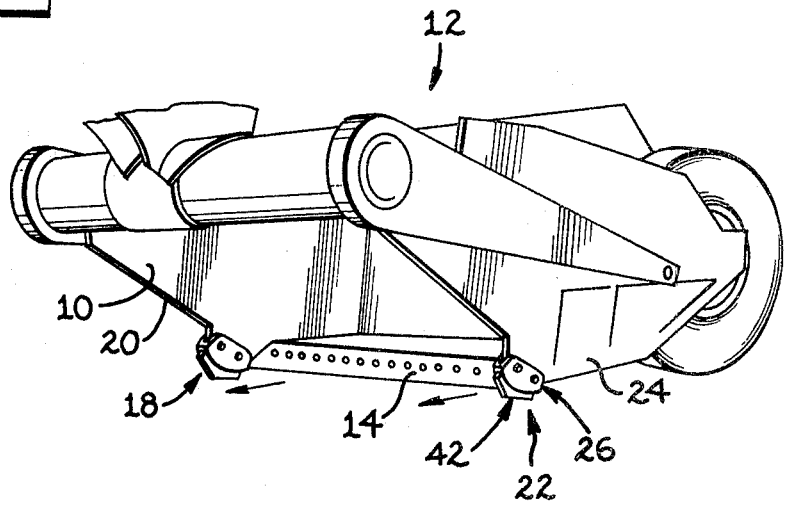
FIG. 1 is a perspective view of a bowl of an earth-working scraper having two router bit assemblies incorporating an embodiment of the present invention.

Referring to FIG. 1, a tractor (not shown) draws a bowl 10 of an earthmoving scraper 12 forward in the direction of the arrows so that an earth-engaging blade 14 engages the ground, which ground is then deposited in the bowl 10 for transport or removal. The end portions of the blade 14 are adjacent a pair of vertical side walls 20 and 24 of the bowl. One router bit assembly 18 is secured to the vertical side walls 20 of bowl 10 and a similar router bit assembly 22 is secured to the vertical side wall 24 of said bowl 10. The router bit assemblies 18,22 define the side boundaries of the blade 14 and cut a sharp edge into the earth during operation.

Figure 2:
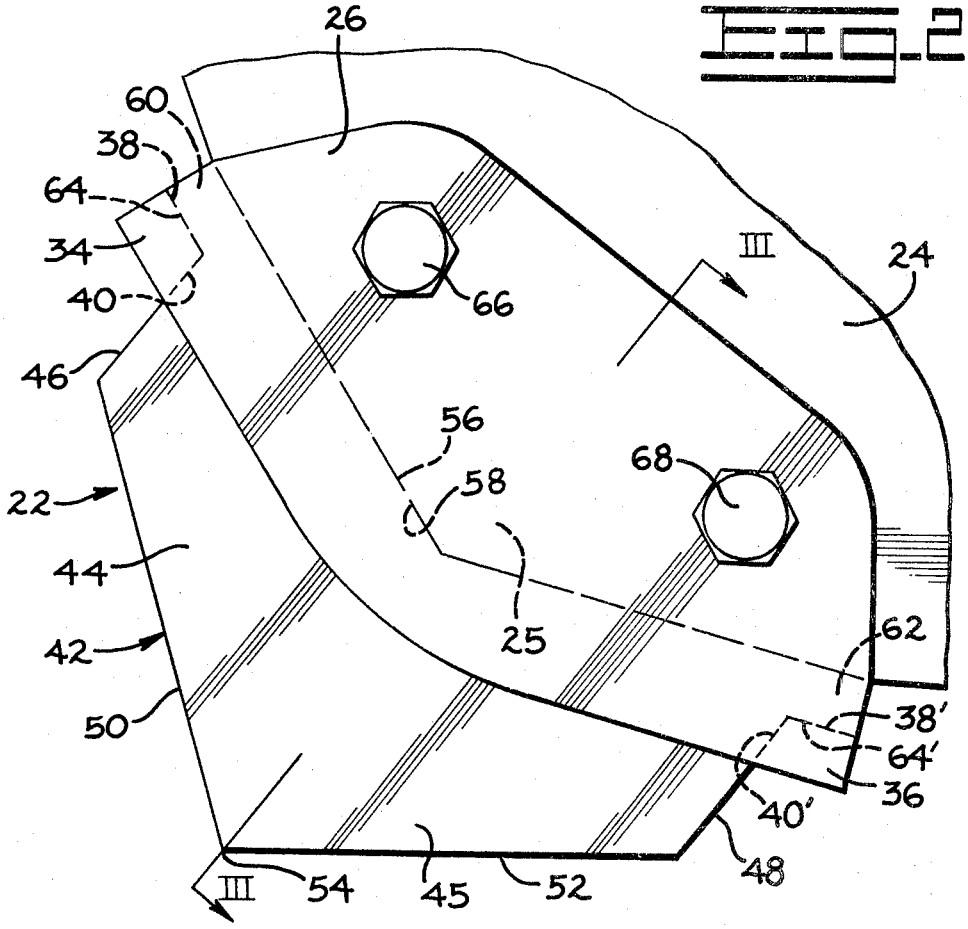
FIG. 2 is a side view of one of the router bit assemblies coupled to the bowl of the earthmoving equipment.
Figure 3:
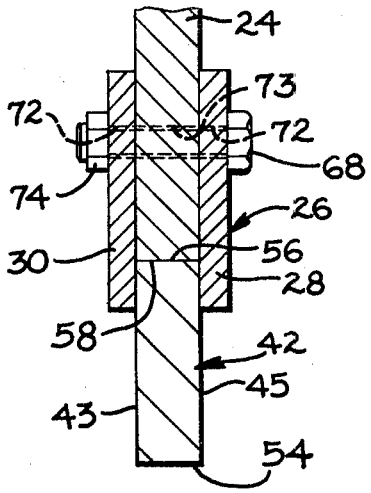
FIG. 3 is a cross-sectional view of the router bit assembly taken along the line 3—3 of FIG. 2.
Figure 4:
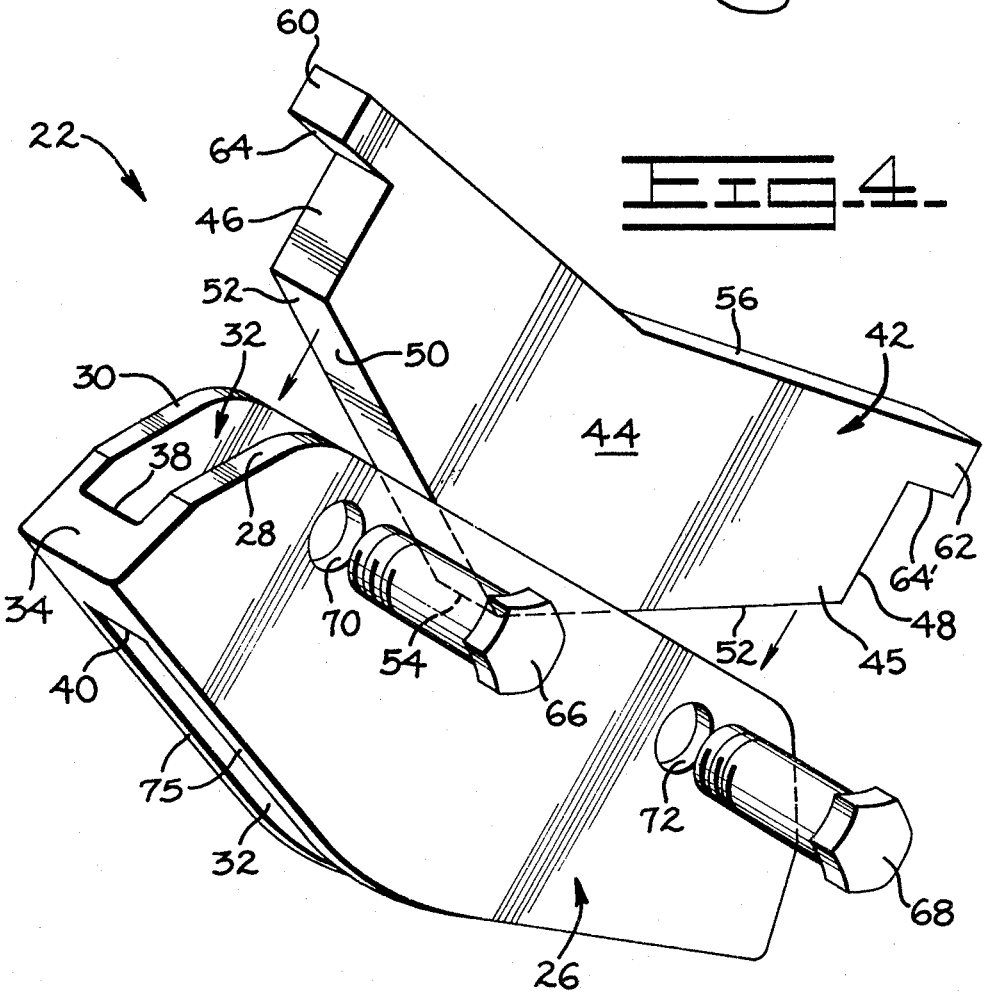
FIG. 4 is a perspective, exploded view of the router bit assembly of an embodiment of the present invention.

Referring to FIGS. 2–4, the construction of the router bit assembly 22 attached to a corner portion 25 of the vertical wall 24 of bowl 10 will now be explained, it being understood that the configuration of the router bit assembly 18 is identical to that of router bit assembly 22.

The router bit assembly 22 includes a holder 26 having spaced-apart bifurcated sides 28 and 30 which define a slot 32 (FIG. 4) therebetween. The sides 28 and 30 are retained in spaced-apart relationship by integrally formed spacer portions 34 and 36. The integrally formed spacer portion 34 defines bit-engaging surfaces 38 and 40 within slot 32 and integrally formed spacer portion 36 defines bit-engaging surfaces 38' and 40' for retaining a bit 42, and will be discussed in greater detail below.

Bit 42 includes body portion 44 defined by parallel side walls 43,45 and end walls 46 and 48. Ground-engaging forward walls or surfaces 50 and 52 taper forwardly from end walls 46 and 48, respectively, to form a leading point 54. A rear edge 56 of bit 42 is contoured to fit the selected configuration of a leading edge 58 of the corner 25 of the vertical side wall 24, as best seen in FIG. 2.

The body portion 44 of the bit 42 has laterally extending flanges 60 and 62 that project outwardly from the end walls 46 and 48, respectively. The flanges 60 and 62 overhang the end walls 46,48 and have holder-engaging surfaces 64 and 64', respectively, which abut surfaces 38 and 38' on spacer portions 34,36 when the bit 42 is received within the slot 32 in the holder 26. At the same time, the end walls 46,48 of the bit 42 about against inwardly facing surfaces 40,40' on said spacer portions 34,36.

When bit 42 is received within the slot 32 in the holder 26 and the rear edge 56 of the bit 42 engages the leading edge 58 of the corner 25 of the bowl wall 24, bolts 66 and 68 are inserted through aligned holes 70 and 72 in sides 28,30 in the holder 26 and through holes 73 in vertical bowl wall 24 whereupon nuts 74 on the bolts will retain the holder 26 in straddling relationship to the corner 25 of vertical bowl wall 24. Any known fasteners 66,68 could be used, such as pins, or the like. The bit 42 is thereby captured between the leading edge 58 of corner 25 and the holder 26 by the flanges 60 and 62 on the bit engaging with the bit-engaging surfaces 38, 38', 40 and 40' on the integrally-formed spacer portions 34 and 36 on the holder 26.

Industrial Applicability

When the bit 42 is worn away to a point approaching the leading edges 75 of the holder 26, bolts 66 and 68 are removed to detach the router bit assembly from the vertical wall 24 of the bowl 10. The router bit 42 is withdrawn from the holder 26 through the rear of the slot 32. A new bit 42 is then inserted within holder 26 which is then reattached to the vertical side wall 24 of bowl 10 by bolts 66,68 and nuts 74.

The mounting of the holder 26 in straddling relationship to the leading edge of the wall of the bowl 10, with the rear wall 56 of the bit 42 bearing against the leading edge 58 of the bowl, reduces the shear loads on the pins or bolts. That is, the forces on the bit 42 are mostly transmitted through the bit 42 and directly into the wall of the bowl. The holder 26 and bolts 66,68 serve more to stabilize the bit 42 and to prevent bending or laying over of the bit relative to wall 24 of the bowl 10. The main load on the bit 42 is passed directly to the wall and not to the bolts 66,68, holder 26 and then to the wall.

I claim:

1. A router bit assembly (18,22) adapted to be mounted on an earthmoving machine (12) having a side wall (24) with a leading edge (58) comprising:

a router bit (42) having a rear edge (56);

a holder (26) for said router bit (42), said holder including a pair of side walls (28,30), a pair of spacer portions (34,36) on said holder for holding the side walls spaced apart and for defining a slot (32) therebetween, said router bit being seated in and retained by said slot (32) with said rear edge in abutting relationship with said leading edge (58) of said side wall (24) of said machine; and means (66,68) for fastening the walls (28,30) of said holder (26) to opposite sides of said side wall (24) of said machine (12).

2. A router bit assembly (18,22) adapted to be mounted on an earthmoving machine (12) comprising:

a router bit (42);

a holder (26) receiving and retaining said router bit (42) in abutting relationship with a leading edge (58) of said machine;

means (66,68) for fastening said holder (26) to said machine;

said router bit including a body portion (44) having at least two flanges (60,62) extending outwardly therefrom and adapted to engage said holder (26) wherein said body portion (44) is defined by parallel end walls (46,48) and ground-engaging surfaces (50,52) tapering forwardly to form a point (54).

3. The router bit assembly (18,22) of claim 2 wherein said holder (26) includes:

a first side (28) and a second side (30); and spacer means (34,36) for retaining said first side (28) in spaced-apart relationship with said second side (30) to define a slot (32) therebetween for receiving said router bit (42) wherein said flanges (60,62) engage said spacer means (34,36), said spacer means (34,36) on said holder (26) holding the rear edge (56) of said flanges (60,62) and of said bit (42) in abutting relationship with the leading edge (58) of said machine (12).

4. A router bit assembly (18,22) adapted to be mounted on an earthmoving machine (12) comprising:

a router bit (42);

a holder (26) receiving and retaining said router bit (42) in abutting relationship with a leading edge (58) of said machine, said holder (26) including a first side (28), a second side (30), spacer means (34,36) retaining said first and second sides (28,30) in spaced-apart relationship to provide a slot (32) therebetween; and fastening means (66,68) passing through bolt-receiving holes (70,72) in said sides (28,30) for retaining said holder (26) against said machine (12).

5. The router bit assembly (18,22) of claim 4 wherein said fastening means (66,68) are bolts.

6. A router bit assembly (22) adapted to be mounted on a vertical side wall (20,24) of a bowl (10) of an earthmoving machine (12) comprising:

a holder (26) having a first side (28) and a second side (30);

spacer means (34,36) between said first and second sides (28,30) in spaced-apart relationship to define a slot (32) therebetween;

a bit (42) having a body portion (44), at least two flanges (60,62) extending outwardly therefrom, said body portion (44) adapted to be received in said slot (32) in said holder (26) and said flanges (60,62) engaging with said spacer means (34,36);

said body portion (44) having a rear edge (56) adapted to engage with a leading edge (58) of said side wall (20,24); and means (66,68) for fastening said holder (26) to said side wall (20,24);

said bit (42) being captured between said holder (26) and leading edge (58) of said side wall (20,24) wherein said bit (42) is secured to said side wall (20,24).

7. In an earthmoving vehicle (12) having a bowl (10), an earth-engaging blade (14) having ends adjacent vertical side walls (20,24) of the bowl (10), each said vertical side wall (20,24) of the bowl (10) having a leading edge (58), a router bit assembly (18,22) mounted on each vertical side wall (20,24) adjacent each end portion of said blade (14) comprising:

a router bit (42) having a rear edge (56);

a holder (26) for said router bit (42), said holder having a pair of parallel side walls (28,30) held in spaced apart relationship by a pair of spacers (34,36) to define a slot (32) therebetween, said router bit seating in said slot (32) with said rear edge (56) retained against said leading edge (58) of said side walls (20,24) of said bowl (10); and means (66,68) for fastening said side walls (20,24) of said holder (26) to opposite sides of one of said vertical side walls (20,24) of said bowl (10).

8. In an earthmoving vehicle (12) having a bowl (10), an earth-engaging blade (14) having ends adjacent vertical side walls (20,24) of the bowl (10), a router bit assembly (18,22) mounted on each vertical side wall (20,24) adjacent each end portion of said blade (14) comprising:

a router bit (42);

a holder (26) receiving said router bit (42) and retaining a rear edge (56) of the bit (42) against a leading edge (58) of said side walls (20,24) of said bowl (10); and means (66,68) for fastening said holder (26) to said bowl (10) extending through said holder (26) and through said vertical side walls (20,24) for trapping said bit (42) against said leading edge (58) of said side walls (20,24).

9. In an earthmoving vehicle (12) as claimed in claim 8 wherein said fastening means (66,68) are bolts.

* * * * *